United States Patent [19]

Cattarozzi

[11] Patent Number: 5,004,116

[45] Date of Patent: Apr. 2, 1991

[54] MODULAR SECTIONAL CONTAINER WHICH CAN BE TRANSPORTED MANUALLY, FOR CONSERVING SUBSTANCES, IN PARTICULAR FOR ALIMENTARY USE

[76] Inventor: Andrea Cattarozzi, Via della Mattonaia, 21, Florence, Italy

[21] Appl. No.: 400,207

[22] Filed: Aug. 29, 1989

[30] Foreign Application Priority Data

Sep. 2, 1988 [IT] Italy ..... 11716/88[U]

[51] Int. Cl.[5] ..... A47F 5/00; B65D 6/12

[52] U.S. Cl. ..... 220/4.34; 248/188.6; 248/166; 220/23.4; 220/4.33; 312/108; 312/111

[58] Field of Search ..... 220/4 F, 23.2, 23.4, 220/23.6; 248/165, 166, 188.6; 403/407.1, 231, 246, 245; 52/280, 281; 312/108, 111, 140

[56] References Cited

U.S. PATENT DOCUMENTS

| | | | |
|---|---|---|---|
| 1,919,439 | 7/1933 | Little | 248/166 |
| 2,340,545 | 2/1944 | Marsh | 403/407.1 |
| 2,371,493 | 3/1945 | Aschinger | 312/140 |
| 2,507,379 | 5/1950 | Morrison | 312/108 |
| 3,099,428 | 7/1963 | Heyer | 248/166 |
| 3,160,307 | 12/1964 | Morrison | 220/4 F |
| 3,261,493 | 7/1966 | Smith | 220/4 F |
| 3,315,639 | 4/1967 | Close | 220/4 F |
| 3,334,175 | 8/1967 | Vincent | 312/140 |
| 3,455,480 | 7/1969 | Mitchell et al. | 220/23.4 |
| 3,661,434 | 5/1972 | Alster | 312/108 |
| 3,722,704 | 3/1973 | Piretti | 312/108 |
| 3,730,568 | 5/1973 | Giovannetti | 403/245 |
| 3,822,924 | 7/1974 | Lust | 312/111 |
| 3,856,147 | 12/1974 | Piretti | 312/108 |
| 4,008,553 | 2/1977 | Oliver | 220/4 F |
| 4,033,570 | 7/1977 | Curlow | 403/231 |
| 4,078,847 | 3/1978 | Presnick | 312/111 |
| 4,120,600 | 10/1978 | Rees | 403/231 |
| 4,272,207 | 6/1981 | Lautenschlager | 403/407.1 |
| 4,274,688 | 6/1981 | Zacky | 312/140 |
| 4,479,340 | 10/1984 | Alphonse | 248/165 |
| 4,492,215 | 1/1985 | Digianvittorio | 220/4 F |
| 4,505,402 | 3/1985 | Gerhard | 220/4 F |
| 4,515,280 | 5/1985 | Sheu | 312/140 |
| 4,609,116 | 9/1986 | Simms | 220/4 F |
| 4,634,309 | 1/1987 | Dewey | 403/407.1 |

FOREIGN PATENT DOCUMENTS

| | | | |
|---|---|---|---|
| 1259532 | 1/1968 | Fed. Rep. of Germany | 220/23.4 |
| 2543755 | 4/1977 | Fed. Rep. of Germany | 220/23.4 |

*Primary Examiner*—Stephen Marcus
*Assistant Examiner*—S. Castellano
*Attorney, Agent, or Firm*—Browdy and Neimark

[57] ABSTRACT

A modular sectional container for conserving substances, in particular for alimentary use, fit for being manually transported having the walls formed by panels made of insulating material, the edge of each panel being formed by two substantially V-arranged faces. Along both the faces of said edge which form a 90° angle between them, there is formed a continuous groove for accommodating tridimensionally extending sealing means with the same shape as that of said container. In the vicinity of each corner of said panels, and on both surfaces, there are provided engaging means for connection means designed to join at least three panels together.

2 Claims, 5 Drawing Sheets

MODULAR SECTIONAL CONTAINER WHICH CAN BE TRANSPORTED MANUALLY, FOR CONSERVING SUBSTANCES, IN PARTICULAR FOR ALIMENTARY USE

DESCRIPTION

1. Field of the Invention

The present invention relates to a modular sectional container which can be transported manually, for conserving substances, in particular, although not exclusively, for alimentary use.

2. Background art

Various types of containers for conserving alimentary and other types of substances at an approximately constant temperature are known: from ordinary thermal bags, to isothermal containers for transporting food in the catering sector, to modular for campsites and communities. The limitations of the features which these solutions offer, mainly resulting from the specific nature of the applications for which they have been designed and marketed, are also known. Thus, the easy trasportability of thermal bags is offset by a limited available volume and a lack of an independent heat source (for cooling or heating). Some types of isothermal containers for food, on the other hand, possess the feature that their overall size can be reduced significantly by folding the walls and also owing to a suitable modular structure which allows them to be stacked, but their dimensions are, however, such as to preclude manual transportation thereof. For campsites and communities, blocks have been proposed, intended for permanent installation and consisting of a multiplicity of single cells which are hired out, or at any rate issued for use to consumers, and equipped with an independent heat source. These blocks in general consist of a standard number of cells, generally 16 or 20, thereby only making it possible to form blocks consisting of an equal number of cells or a multiple of the basic block, even when an intermediate number of cells is required or would be sufficient.

None of the solutions proposed hitherto for thermal containers for foodstuffs and other substances is able to satisfy simultaneously the varied requirements above, such as easy and convenient transportability, including manual transportation, a sectional design of the container and hence the possibility of reducing its overall size when not in use, ease of assembly and disassembly and a modular structure. Such simultaneous features are needed in particular in non-residential temporary premises (campsites, building sites, civil defence or emergency situations) or in similar cases, where the transportation, containment and storage not only of the substances, but also of the container itself, are subject to special requirements.

Already known from Italian Patent No. 1198827, in the name of the same Applicant, moreover, is a sectional and modular structure designed to form containers for solid, liquid and gaseous materials, which consists of single cells which can be assembled together in modular form in one, two or three directions, each cell being formed by means of containment walls which can be combined together in a sealed manner along their respective edges and can be fixed to each other by means of suitable fixing accessories. According to this patent application, the connection between the cells was effected by means of annular connecting elements which can be inserted between the cells in place of two respective walls, while the sealing effect is ensured by means of a continuous, tridimensionally extending with the same shape as that of a single cell. This structure, appropriately adapted, appears to be suitable for satisfying the requirements above.

SUMMARY OF THE INVENTION

The object of the present invention is, therefore, to provide a sectional, modular container which can be easily transported, including manually, and which is suitable for conserving at a constant temperature substances, in particular, but not exclusively, of the alimentary type.

The container according to the invention, in its basic configuration, consists of six panels made of insulating material, arranged in a parallelepiped, and preferably a cube, the edge of which is V-shaped, forming a 90° angle. Along the edge of said panels, symmetrically relative to the edge of the latter, there are formed two continuous grooves for accommodating tridimensionally extending sealing means, with the same shape as that of the container, while in the vicinity of each corner of said panels, and on both surfaces, there is provided an engaging seat for connection means designed to join at least three panels together. The container according to the invention comprises, moreover, a base element having folding legs designed to be fixed, in the extended position, to one of said panels, in the region of the engaging seats provided on its external surface. The container according to the invention is moreover equipped with ties, preferably accommodated in an extractable manner inside said folding legs for binding said panels in a stacked and compact form.

BRIEF DESCRIPTION OF THE DRAWINGS

The invention will now be described in detail by means of the description which follows of an embodiment thereof, by way of a non-limiting example, with reference to the accompanying drawing in which.

DESCRIPTION OF A PREFERRED EMBODIMENT

Figure 1:
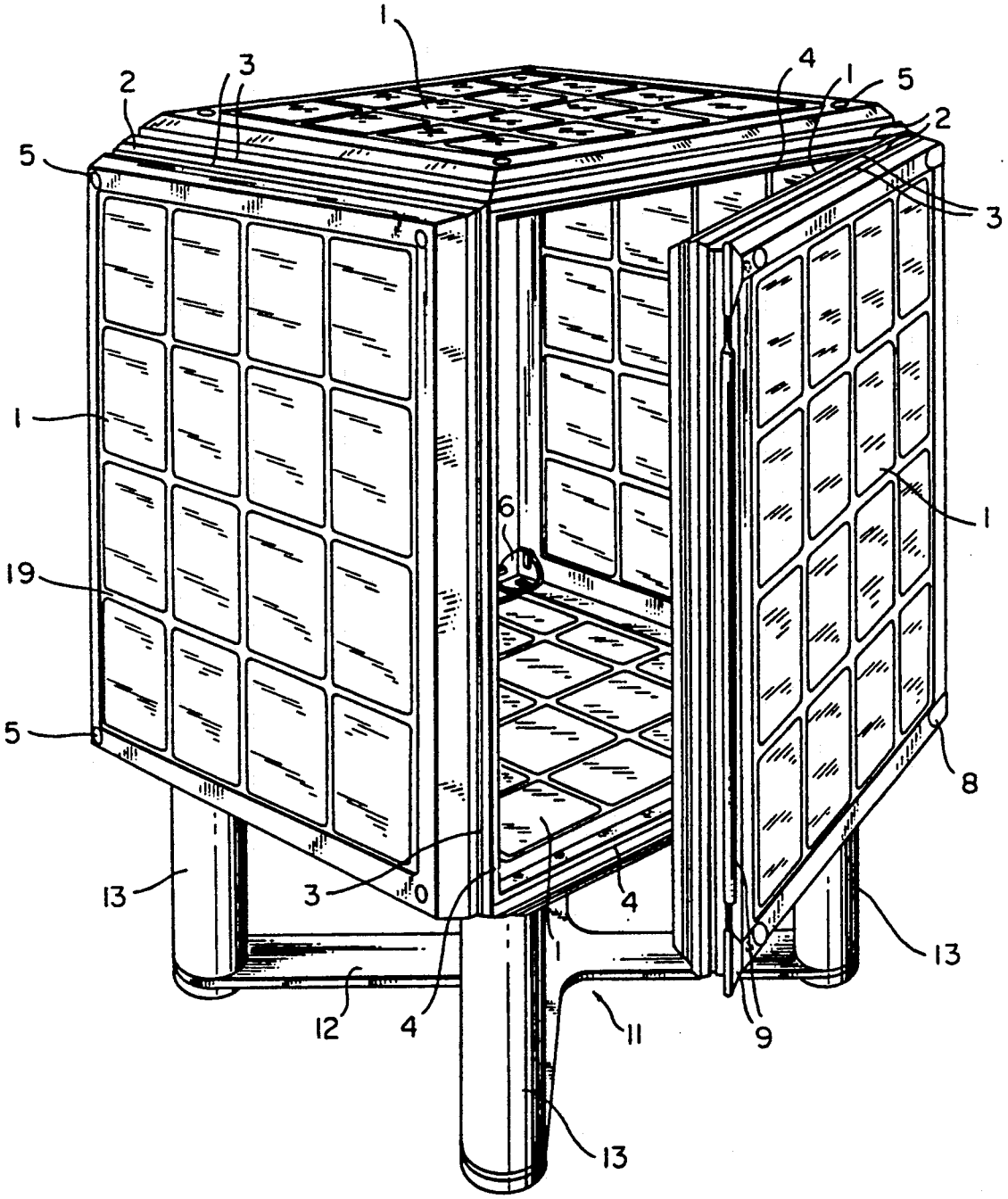
FIG. 1 is a perspective view of the container according to the invention.
Figure 2:
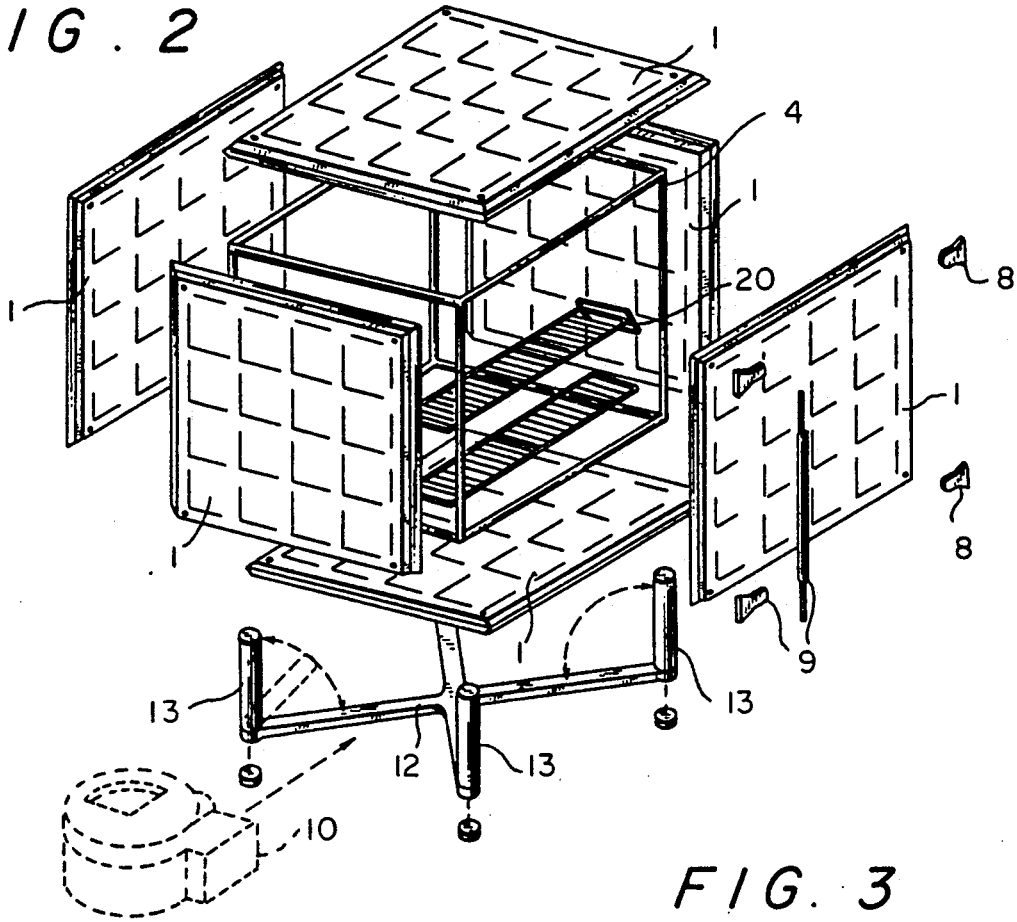
FIG. 2 is an exploded perspective view of the container shown in FIG. 1.

With reference to FIGS. 1 and 2, the container according to the invention is formed by six panels 1 of thermally insulating material, identical to each other and square in shape, joined together in a cube-like configuration. The perimetral edge 2 of each of the panels 1 is V-shaped, being defined by two converging faces and forming between them an angle of 90°. Along the edge 2 of each panel, in a symmetrical position with respect to the edge, there run two continuous grooves 3 designed to accommodate a sealing element 4, shown in FIG. 2, which will be referred to below.

Figure 4:
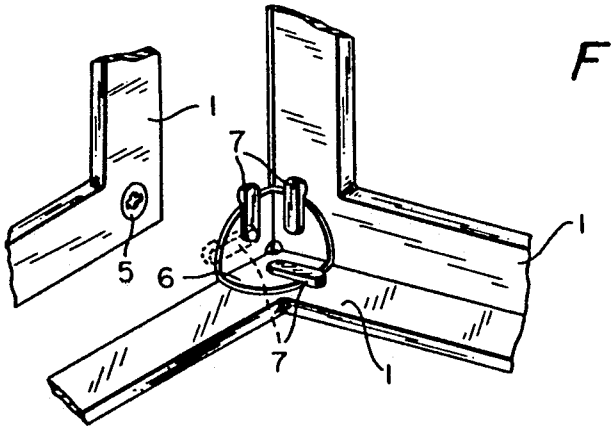
FIG. 4 is a detailed view of an element for the connecting the panels.

On both the faces of the panels 1 and in the vicinity of each corner there is formed a corresponding engaging seat 5, illustrated in greater detail in FIG. 4, suitable for engagement with a complementary male element, not shown, provided on a fixing angle iron 6 designed t join perpendicularly together three panels 1 in the region of the corner formed by them. More particularly, as shown in FIG. 4, the fixing angle iron 6 is a small plate made of strong material with three mutually orthogonal faces, from the outside of which projects said male element integral with a corresponding arm 7, extending from the inside of the said faces, which may be rotated from an insertion position, shown in broken lines in FIG. 4, in which the male element may be inserted into the seat 4 of the panel 1 opposite, to a locking position, rotated through 90°, in which the male element cannot escape from the seat 5. The slight force required to move the arms 7 from the insertion position to the locking position, ensures a stable connection of the three panels along the respective matching edges. The sealing effect along these edges is achieved by means of the 4 which extends along the edges of a cube with dimensions the same as those of the container.

One of the panels of the container is provided with hinges 8 and a closing device 9, while another of the panels is provided with suitable passages for connections between the radiating element (not shown) situated inside the container and the heat source (for cooking or heating) indicated by 10 and illustrated schematically in FIG. 2.

Figure 6:
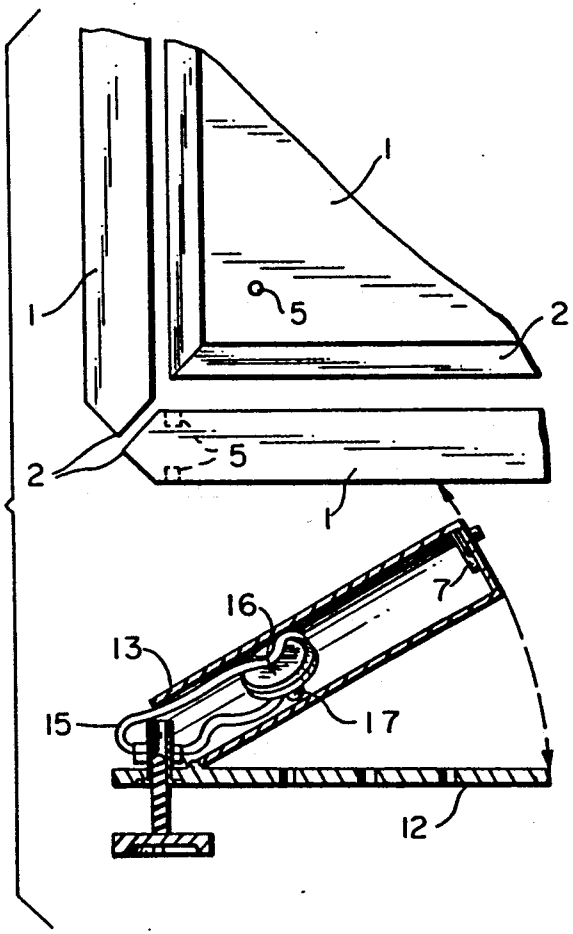
FIG. 6 illustrates folding of the leg according to FIG. 5.
Figure 5A:
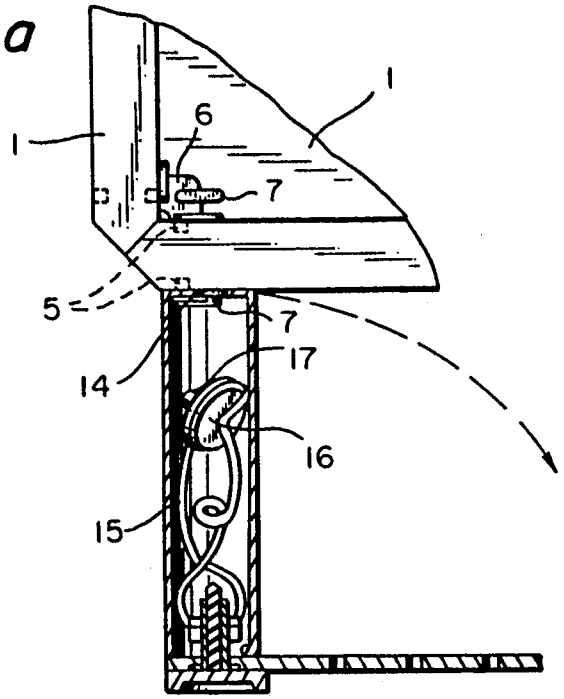
FIG. 5, details a) and b), shows respectively a side view and a plan view of a folding leg for the container according to the invention.
Figure 5B:
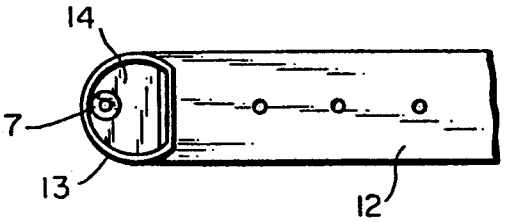
Figure 7A:
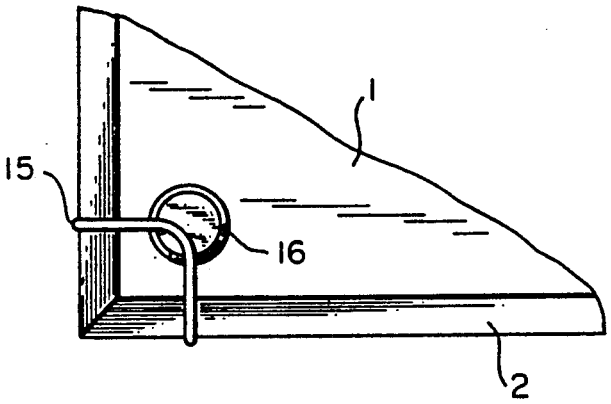
FIG. 7 details a) and b), shows respectively a plan view and side view of a container according to the invention in its disassembled and stacked form.
Figure 7B:
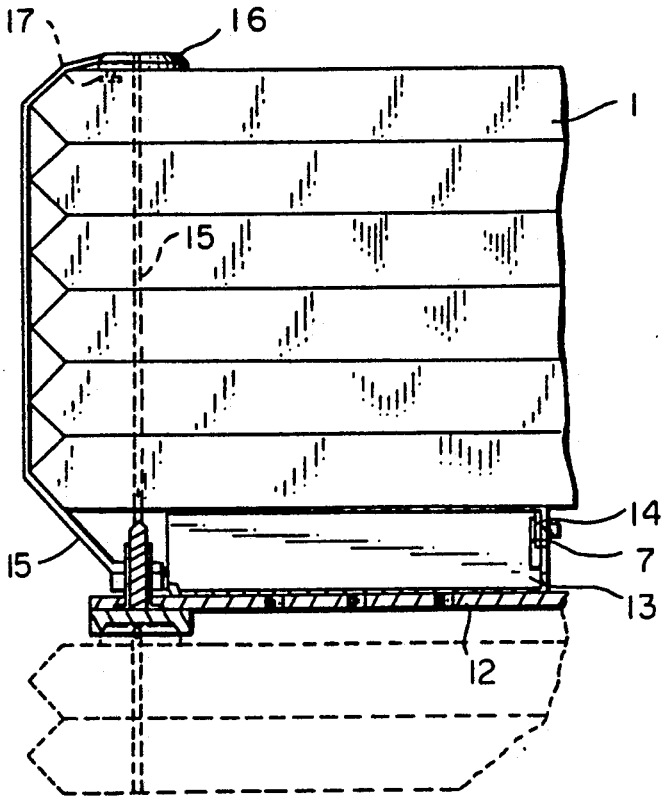

The container according to the invention also comprises a base element, generally indicated by 11, consisting of a cross-shaped support 12, at the ends of which are provided four legs 13 hinged with the cross-shaped support 12 so as to be able to be folded from a position orthogonal to said support, illustrated in FIGS. 1 and 2, to an extended position thereon and vice versa, as shown also in FIGS. 5, 6 and 7. The legs 13 are fixed to the base panel 1 by means of small plates 14 carrying connection elements similar to those provided for the angle irons 6 and using the same engaging seats 5.

Figure 8B:
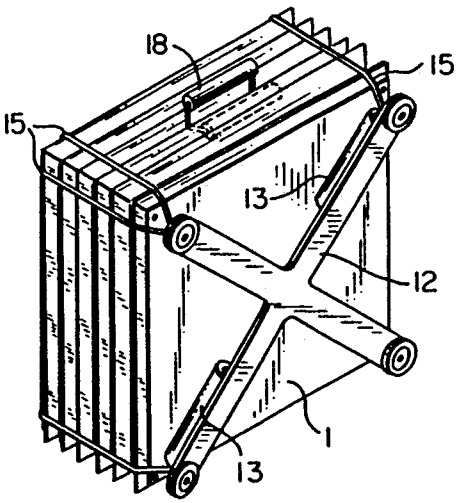
FIG. 8, details a) and b), shows, two perspective views of a container according to the invention in its disassembled and stacked form, suitable for manual transportation.
Figure 8A:
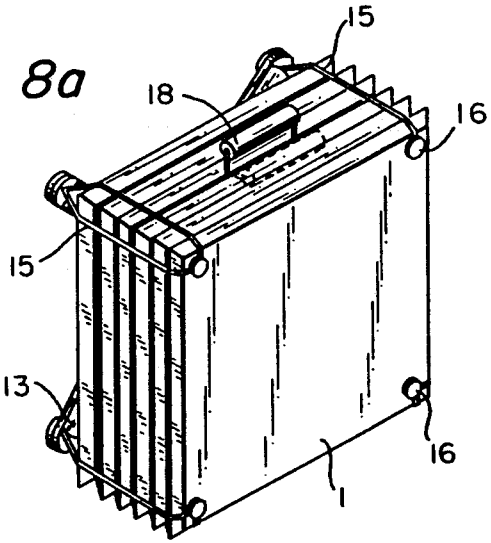

Advantageously the folding legs 13 are hollow and may accommodate inside them a tie 15, consisting of string, fibre or other suitable material, halfway along which there is fixed a button 16 from which a male element 17 projects, designed to engage in the engaging seats 5. The two ends of the tie 15 are fixed to the cross-shaped support 12. The ties 15 are extracted from the legs 13 after they have been folded onto the support 12 during disassembly of the container. The panels 1 are separated, the angle irons 6 being removed, and consistency stacked one on top of the other, as shown in FIG. 7, above the already folded legs 13. Each tie 15 is extended along the corresponding edge of the stack of panels so that the male element 17 of the button 16 can be engaged in the engaging seat 4 of the highest panel in the stack. FIG. 8 illustrates the resulting configuration of the container once disassembled and stacked as described, a configuration which is extremely compact and can be easily transported, on account also of the handle 18 which can be applied externally, using one of the grooves 19 mentioned below.

Figure 3:
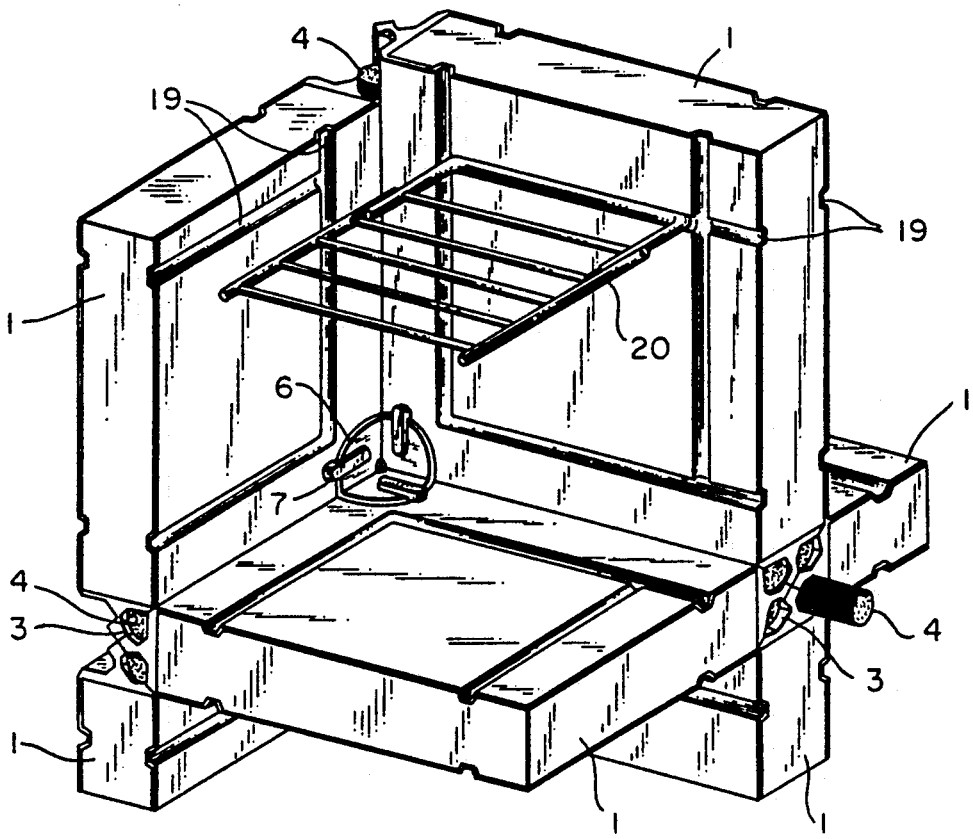
FIG. 3 is a cut-away perspective view of a container with several cells.
Figure 9:
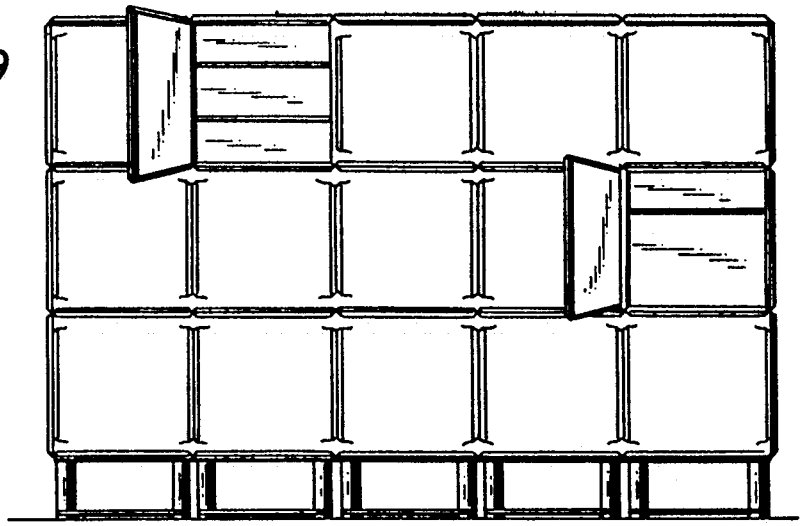
FIG. 9 illustrates a block with several cells, formed using containers according to the invention.

Given the modular nature of all its components, the container according to the invention may be used to make up, tridimensionally, blocks of thermal cells as illustrated in FIG. 9, with the advantage that they can be formed from any number of cells and that one and the same panel is used to construct two contiguous cells, as shown in FIG. 3. This eliminates doubling of the thickness between contiguous cells, typical of conventional systems, and allows the same result to be obtained using less material.

The faces of the panel 1 may advantageously have formed in them a network of grooves 19, visible in particular in FIG. 3, which acts as a support for racks 20 intended to support substances and food.

The container according to the invention enables significant advantages to be achieved simultaneously compared to similar conventional systems and in particular, in addition to its modular and sectional nature, can be easily assembled and disassembled and easily transported, included manually, in a compact form of reduced size. Moreover, it permits the formation of blocks of multiple cells without any restriction as to number and using a smaller quantity of materials and components which may be easily integrated and/or replaced if necessary. Furthermore, it should be noted that the container according to the invention, both in its individual and combined configuration, is able to use various forms of energy supply for the refrigerating section without any modifications having to be made to any of its components.

The invention is not limited to the embodiment described and illustrated above, but comprises any variation thereof.

I claim:

1. Modular sectional container for conserving substances and which can be transported manually comprising:

panels made of insulating material, each panel forming a wall thereof, wherein a perimetral edge of each panel is V-shaped and defined by two converging faces of said edge, having an angle of 90° between them, there being formed along the edge of each panel two continuous grooves to accommodate tridimensionally extending sealing means having a shape as that of said container in a vicinity of corners of said panel and on edge surfaces of said panels and wherein there is provided an engaging seat for a connection means that joins at least three panels together;

wherein said connection means are angle elements having three orthogonal faces from each of which projects a male connecting element designed to be engaged inside said engaging seat of the panel located adjacent and mounted rotatably on said angle element so as to be anchored inside said seat by means of rotation through a predetermined angle;

wherein there is provided a base element comprising folding legs designed to be fixed, in an extended position, to one of said panels in a region of said engaging seats on its external surface; and wherein extractable ties for binding said panels in a stacked and compact form are accommodated inside said legs.

2. Modular sectional container for conserving substances and which can be transported manually comprising:

panels made of insulating material, each panel forming a wall thereof, wherein a perimetral edge of each panel is V-shaped and defined by two converging faces of said edge, having an angle of 90° between them, there being formed along the edge of each panel two continuous grooves to accommodate tridimensionally extending sealing means having a shape as that of said container in a vicinity of corners of said panel and on edge surfaces of said panels and wherein there is provided an engaging seat for a connection means that joins at least three panels together;

wherein said connection means are angle elements having three orthogonal faces from each of which projects a male connecting element designed to be engaged inside said engaging seat of the panel located adjacent and mounted rotatably on said angle element so as to be anchored inside said seat by means of rotation through a predetermined angle;

wherein there is provided a base element comprising folding legs designed to be fixed, in an extended position, to one of said panels in a region of said engaging seats on its external surface;

wherein extractable ties for binding said panels in a stacked and compact form are accommodated inside said legs; and wherein said ties are fixed by their ends to said base element and carry in a middle position a bottom from which projects a male connecting element that engages inside said engaging seat, so that, when said panels are arranged in said stacked form above said base element with said legs folded, said ties having a button with a male connecting element fixed inside a corresponding engaging seat of a first panel of the stack, and the tie may extend along an edge of said stack.

* * * * *